US009333416B2

(12) United States Patent
Olsen

(10) Patent No.: US 9,333,416 B2
(45) Date of Patent: May 10, 2016

(54) PAPER AIRPLANE GAME

(71) Applicant: Jedd Olsen, Draper, UT (US)

(72) Inventor: Jedd Olsen, Draper, UT (US)

( * ) Notice: Subject to any disclaimer, the term of this patent is extended or adjusted under 35 U.S.C. 154(b) by 176 days.

(21) Appl. No.: 13/743,089

(22) Filed: Jan. 16, 2013

(65) Prior Publication Data

US 2014/0027981 A1 Jan. 30, 2014

Related U.S. Application Data

(60) Provisional application No. 61/591,174, filed on Jan. 26, 2012.

(51) Int. Cl.
*A63B 63/00* (2006.01)
*A63F 9/02* (2006.01)

(52) U.S. Cl.
CPC ..... *A63F 9/0204* (2013.01); *A63F 2009/0282* (2013.01)

(58) Field of Classification Search
CPC ..... A63B 63/00
USPC ..... 273/348, 407, 402, 410, 408, 406, 405, 273/404, 399, 359, 317; 248/99; 473/471, 473/466; 434/19–20; D23/297; D21/700
See application file for complete search history.

(56) References Cited

U.S. PATENT DOCUMENTS 2,049,593 A * 8/1936 Schabinger ..... 473/487
3,244,420 A * 4/1966 Poynter ..... 273/402
4,111,422 A * 9/1978 Burcenski ..... A63B 67/02 124/5
5,064,195 A * 11/1991 McMahan et al. ..... 473/480
5,240,259 A * 8/1993 O'Grady ..... 273/402
5,435,511 A * 7/1995 Hsu ..... A01K 63/006 248/206.3
5,480,140 A * 1/1996 Darnell ..... 473/466
7,472,801 B1 * 1/2009 Moynihan et al. ..... 220/694
2002/0105140 A1 * 8/2002 Field ..... 273/245
2014/0027981 A1 * 1/2014 Olsen ..... 273/348

OTHER PUBLICATIONS

Webpage downloax, Amazon, 2011, www.amazon.com/ACCO-Rubber-Bands-Assorted-Colors/dp/B000093L25. 1 page.*
Webpage downloax, moranswoodcomponents, 2012, http://moranswoodcomponents.co.uk,1 page.*
Webpage downloax, ebeanstalk, 2013, www.ebeanstalk.com/FunLoom/toy-product-detail/Deluxe-FunLoom-Kit.html.2 pages.*
Webpage downloax, Amazon2010, 2010, www.amazon.co.uk/dp/B0027EBIZ8.1 page.*

* cited by examiner

*Primary Examiner* — Gene Kim
*Assistant Examiner* — Michael Chambers
(74) *Attorney, Agent, or Firm* — Jarod R. Marrott; Kirton McConkie, P.C.

(57) ABSTRACT

A method for playing a paper airplane game is disclosed. The game is played by, first, positioning a hoop within a playing environment. Next, a paper airplane is thrown towards the hoop. If the paper airplane did not pass through the hoop, the thrower move to the location of the paper airplane re-throw the paper airplane towards the hoop. This process is repeated until the paper airplane passes through the hoop.

14 Claims, 15 Drawing Sheets

PAPER AIRPLANE GAME

RELATED APPLICATION

This application claims the benefit of U.S. Provisional Patent Application No. 61/591,174, entitled "PAPER AIRPLANE GAME," filed on Jan. 26, 2012 by Jedd Olsen.

BACKGROUND

1. Field of the Invention

This application relates generally to systems and methods for providing a recreational activity. More specifically, this application relates to systems and methods for providing a recreational game involving the throwing of paper airplanes through a series of hoops. This application further relates to a kit having a set of articles that can be used to play a paper airplane game. This application still further relates to one or more hoops useful in a paper airplane game, which can be located on various objects in a playing environment.

2. Background

Paper airplanes are toy aircrafts that are made out or paper, paperboard, card stock or another similar material. These toys aircrafts are made, for example, by folding one or more sheets of paper to have one or two wings with a fold of paper below the wing(s) that can be held as the user throws the paper airplane. Numerous styles of paper airplanes are known that can be made by folding one or more sheets of paper using a predetermined pattern.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings.

DETAILED DESCRIPTION OF THE INVENTION

Figure 1:
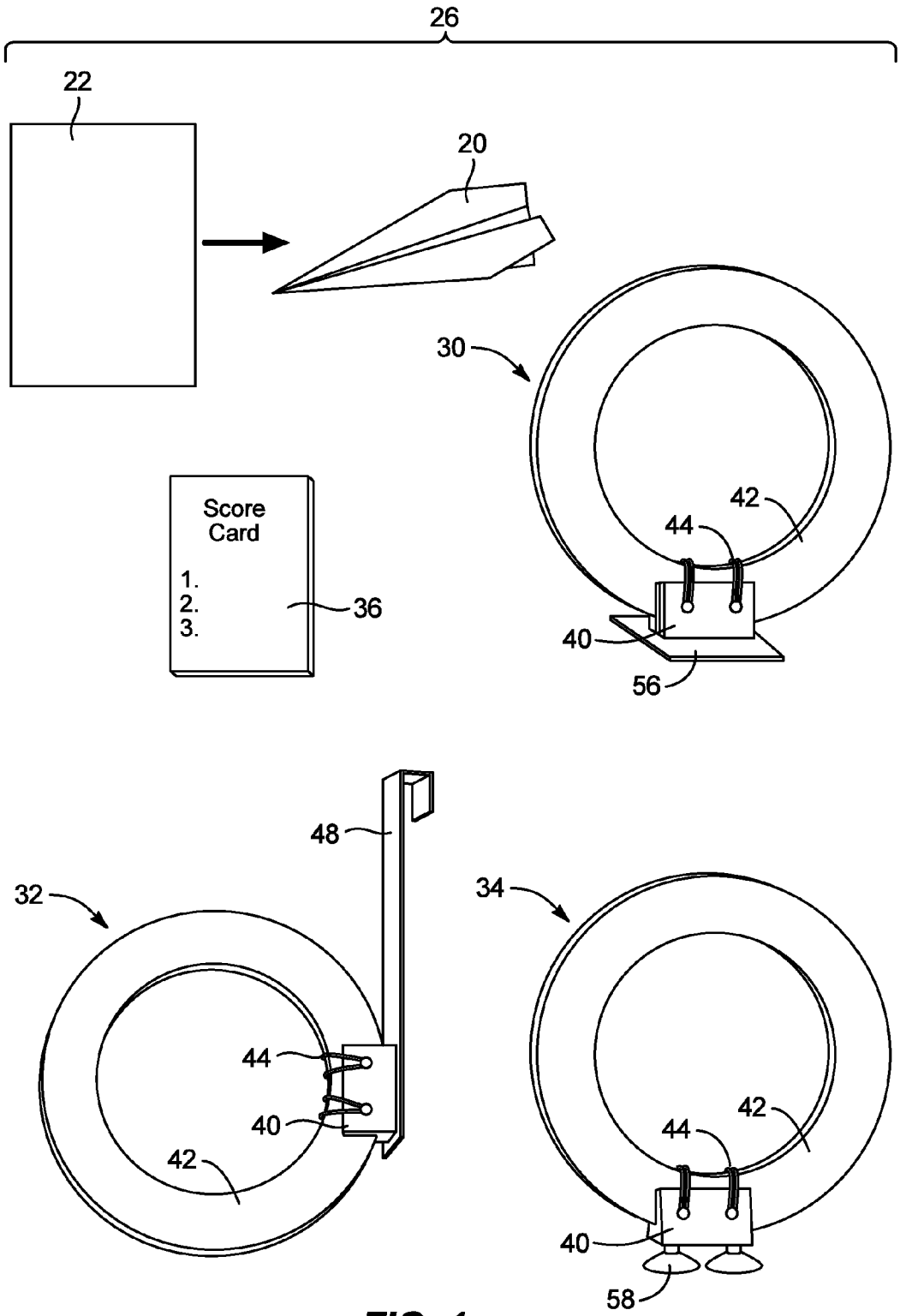
FIG. 1 illustrates a set of components included in a representative kit used in a paper airplane game.

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The description may use perspective-based descriptions such as up/down, back/front, left/right and top/bottom. Such descriptions are merely used to facilitate the discussion and are not intended to restrict the application or embodiments of the present invention.

For the purposes of the present invention, the phrase "A/B" means A or B. For the purposes of the present invention, the phrase "A and/or B" means "(A), (B), or (A and B)." For the purposes of the present invention, the phrase "at least one of A, B, and C" means "(A), (B), (C), (A and B), (A and C), (B and C), or (A, B and C)."

Various operations may be described as multiple discrete operations in turn, in a manner that may be helpful in understanding embodiments of the present invention; however, the order of description should not be construed to imply that these operations are order dependent.

The description may use the phrases "in an embodiment," or "in various embodiments," which may each refer to one or more of the same or different embodiments. Furthermore, the terms "comprising," "including," "having," and the like, as used with respect to embodiments of the present invention, are synonymous with the definition afforded the term "comprising."

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical or electrical contact. However, "coupled" may also mean that two or more elements are not in direct contact with each other, but yet still cooperate or interact with each other.

As used herein the term "paper airplane" refers to any toy aircraft made by folding paper, paperboard, cardstock or another suitable material. Non-limiting examples include such as paper airplanes, paper plane, paper gliders, and paper darts.

This application relates generally to systems and methods for providing a recreational activity. More specifically, this application relates to systems and methods for providing a recreational game involving the throwing of paper airplanes through a series of hoops. In general, the paper airplane game (herein simply "game") can be played by placing a series of hoops within a playing environment and then throwing the paper airplanes through the hoops in order. Each participant may count the number of throws that it takes him/her to successfully throw a paper airplane through each successive hoop. After each participant makes his/her paper airplane through the first hoop, the number of throws taken to successfully make the paper airplanes through this first hoop can be recorded. The participant can then proceed to throw their paper airplane through the second hoop, repeating this process until each participant has thrown their paper airplane through each hoop. If a single throw does not successfully pass through the target hoop, the participant may make the subsequent throw from the location of the paper airplane. The participant who successfully threw his/her paper airplane through each of the successive hoops in the lowest number of throws can be designated as the winner of the game or of the round.

Reference will first be made to FIG. 1, which illustrates a representative paper airplane game kit (or simply "kit") 26 which includes several articles that can be used to play the game. For instance, the kit 26 can include one or more sheets of paper 22 that can be formed into one or more paper airplanes 20. The kit 26 can also include a set of hoops, such as one or more standing hoops 30, one or more door hanging hoops 32, one or more hanging hoops 37 (shown in FIGS. 2 and 16), and/or one or more suction hoops 34. In some instances, the hoops of the kit 26 can include modifiable and/or interchangeable parts, such that the kit 26 includes a set of parts that can be used to make a customized set of hoops for each instance of the game. For example, the kit 26 can include one or more hoops of one or more sizes, one or more of base members 40, one or more hanging rod 48, and/or one or more suction cups 58. In instances where one or more bands 44, such as rubber bands are used to secure the hoop member 42 to the base member 40, one or more bands 44 can also been included in the kit 26. In some instances, the kit 26 can further include a container (not shown), such as a box, a bag, or other suitable container for holding the articles of the kit 26. Also, the kit 26 can optionally include a set of scorecards 36, a pen or other writing instrument, instructions on how to fold one or more types of paper airplanes, and/or instructions on how to play the game.

Figure 2:
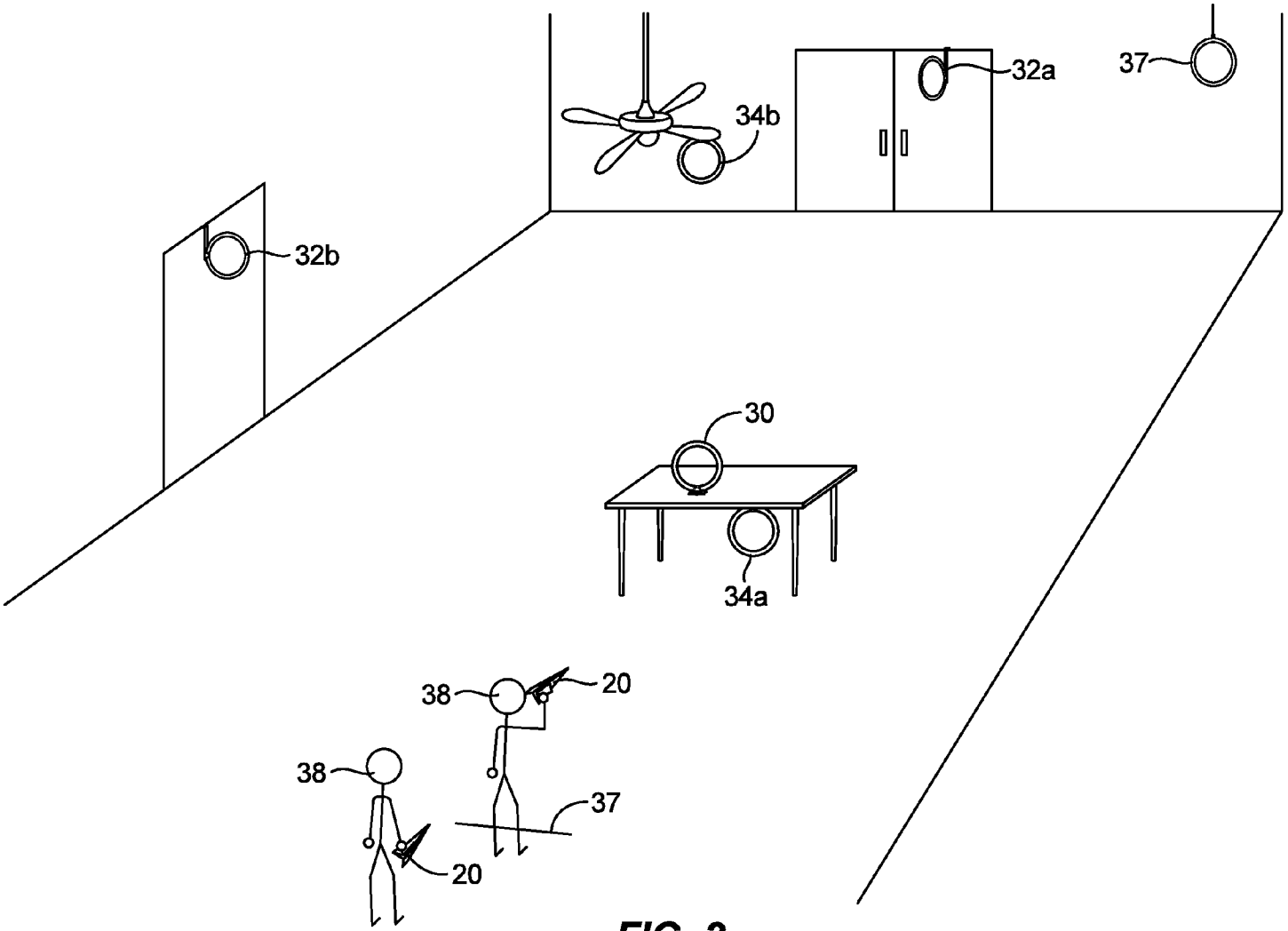
FIG. 2 illustrates a perspective view of a representative instance of a paper airplane game having a set of hoops disposed within a playing environment.

Reference will now be made to FIG. 2, which depicts a playing environment in which six hoops 30, 32*a*, 32*b*, 34*a*, 34*b*, and 37 have been strategically positioned in preparation for the game. It is contemplated that the game be played in a variety of playing environments, such as within a single room, within a set of rooms, in an outdoor environment (e.g., a backyard), or in various other suitable environment. The illustrated playing environment is a relatively large room, such as a living room or a great room. It is further contemplated that the game can be played with any number of hoops, such as, for example, with 1 hoop, 2 hoops, 3 hoops, 4 hoops, 5 hoops, 6 hoops, 8 hoops, 10 hoops, 12 hoops, 18 hoops, or more than 18 hoops.

In preparation for the game, one or more persons can strategically place hoops located within the playing environment. The person or persons who place the hoops can be game participants 38 or neutral third parties. It will be understood, that the placement of the hoops may determine the difficulty of the game. For instance, when hoops are placed very far apart, placed on moving objects, or placed behind objects or barriers, it may be more difficult for participants 38 to complete the game in a relatively small number of throws. Moreover, the size of the hoops placed in the playing environments can provide additional challenges to game participants.

Turning now to the placement of hoops in the playing environment shown in FIG. 2, in some instances, during game setup, hoops can be placed on any accessible object, surface, or location in the playing environment. Representative locations for placing hoops include, for instance, on top of an object, beneath an object, attached to the side of an object, or hanging from an object. For example, hoops can be placed on the ground, on the ceiling, or within an object (e.g., a bookshelf or armoire). Specifically, in the illustrated playing environment, a standing hoop 30 is shown as sitting on top of a table, while a suction hoop 34*a* is depicted as hanging from the bottom of the table. Additionally, another suction hoop 34*b* is depicted as hanging from fan within the playing environment. Two additional hoops, hanging hoops 32*a* and 32*b*, are depicted as hanging on two doors within the playing environment. A hanging hoop 37 is also shown as hanging from a ceiling or other roof structure.

It will be understood that the present hoops, including the standing hoops 30, door hanging hoops 32, hanging hoops 37 (shown in FIGS. 2 and 16), and/or suction hoops 34, can be used with a variety of games and activities having a variety of rules. However, herein, these hoops are described in reference to a paper airplane game.

During setup of the paper airplane game, hoops within the playing environment can be numbered or otherwise assigned an order that will determine the order in which the games is played. Generally, each participant 38 throws his/her paper airplane through each hoop starting with the first hoop and proceeding through each hoop to the last hoop. Accordingly, during play, each participant 38 can attempt to throw is paper airplane 20 through the first hoop. Once the participant 38 successfully throws his/her paper airplane 20 through the first hoop, that participant 38 can then attempt to throw his/her paper airplane 20 through the second hoop, and so on to the last hoop. Alternatively, in some instances, the game is played in a free-for-all style, in which each participant 38 is only required to throw his/her paper airplane through all of the hoop, without regard to order.

The game may begin with each game participant 38 making one or more paper airplanes 20 that he/she will use during the game. In some instances, the participant 38 is required to use only the paper airplane(s) 20 that he/she made. The participants 38 may not allowed to make additional paper airplanes 20 thereafter. However, during play, the participant 38 may be allowed to repair or adjust his/her paper airplane(s) 20. In some embodiments, the kit 26 includes instructions on how to make one or more styles of paper airplanes 20. The instructions can include printed lines on paper that show the user where to fold the sheet of paper 22 to form the paper airplane 20. In some embodiments, instructions or airplane templates can also be downloaded from a related website, printed, and used to make the paper airplanes 20 for the game. The kit 26 can also include colored paper, colored markers, colored pencils, or other such tools for providing color to an paper airplane 20.

With continued reference to FIG. 2, after the one or more paper airplanes 20 are assembled, each participant 38 can throw a paper airplane 20 at each hoop. The participants 38 can take turns throwing according to a predetermined order, they may throw sporadically, or a first participant 38 can play until his/her paper airplane passes through the first hoop. In the latter example, the first participant 38 can then continue to the next hoop, and a second participant 38 can then begin to throw his/her paper airplane through the first hoop, and so on.

In another example, each participant 38 can take turn throwing to a common hoop. After each participant has made his/her initial throw, the participant 38 with the paper airplane farthest from the hoop can be the first to make a second throw. Similarly, the participant 38 with the next farthest plane will go second, and so on, until each participant 38 has thrown the paper airplane 20 a second time or has made their paper airplane 20 through the hoop.

When throwing towards the first hoop, the participants 38 may each line up behind a start line 60 and attempt to throw their respective paper airplanes 20 through the first hoop 34. As illustrated, the first hoop can be the suction hoop 34*a* hanging under table in the center of the playing environment. In some instances, there is also a designated starting line 60 for each subsequent hoop. In other instance, the general start place for each hoop after the first hoop is an area near the last hoop.

In some instances, the object of the game can be for a participant 38 to throw his/her paper airplane 20 through each of the hoops in order in the least number of throws. Thus, the participant 38 with the lowest score number of total throws at the end of the game will be the winner. Scoring can be recorded any number of ways, including on a scorecard 36.

Figure 3:
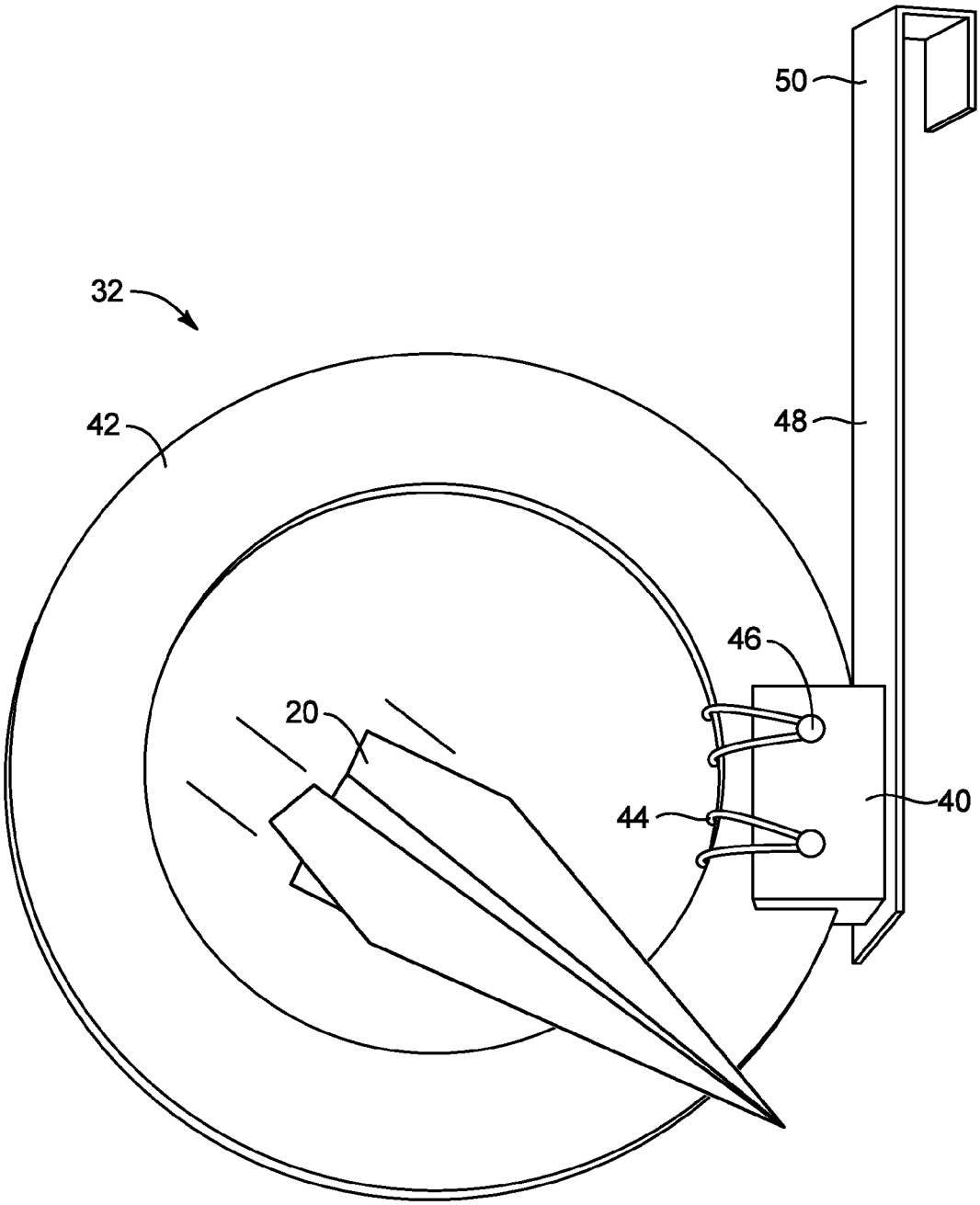
FIG. 3 illustrates a perceptive view of a representative hanging hoop, according to some embodiments.

Reference will now be made to specific embodiments of hoop structures shown in FIGS. 3 to 11. It will be understood, however, that the present invention is not limited to the illustrated and described embodiments. Turning now to FIG. 3, a door hanging hoop 32 is illustrated, which can be hung on various objects during game setup. For example, the door hanging hoop 32 can be hung on a door, a cabinet, other furniture, a clothing line, a pipe, a shelf, a tree, or numerous other objects. This door hanging hoop 32 can provide wide-ranging versatility to the number of locations onto which this hoop can be hung. This same versatility can provide challenge and diversity to the game. As shown, the door hanging hoop 32 can include a hanging rod 48 that is connected to a base member 40, which in turn is connected to a hoop member 42. The hoop member 42 can be removable and can be secured to the base member 40 with one or more bands (e.g., rubber bands, string, elastic strips) 44 that can allow the hoop member 42 to be removed and replaced with a different sized hoop. Also, when incorporated into a kit 26, the removability of the bands allows a user to customize the various hoops used in a game. Alternatively, in some embodiments, the hoop member 42 is fixedly connected to the base member 40, as shown in FIG. 11. In such embodiments, the hoop and base member 40 can form an integrated hoop and base member. Similarly, the base member 40 can be fixedly or removably coupled to the hanging rod 48. As shown, the hanging rod 48 can include a hook portion 50 that forms a hook.

Figure 4:
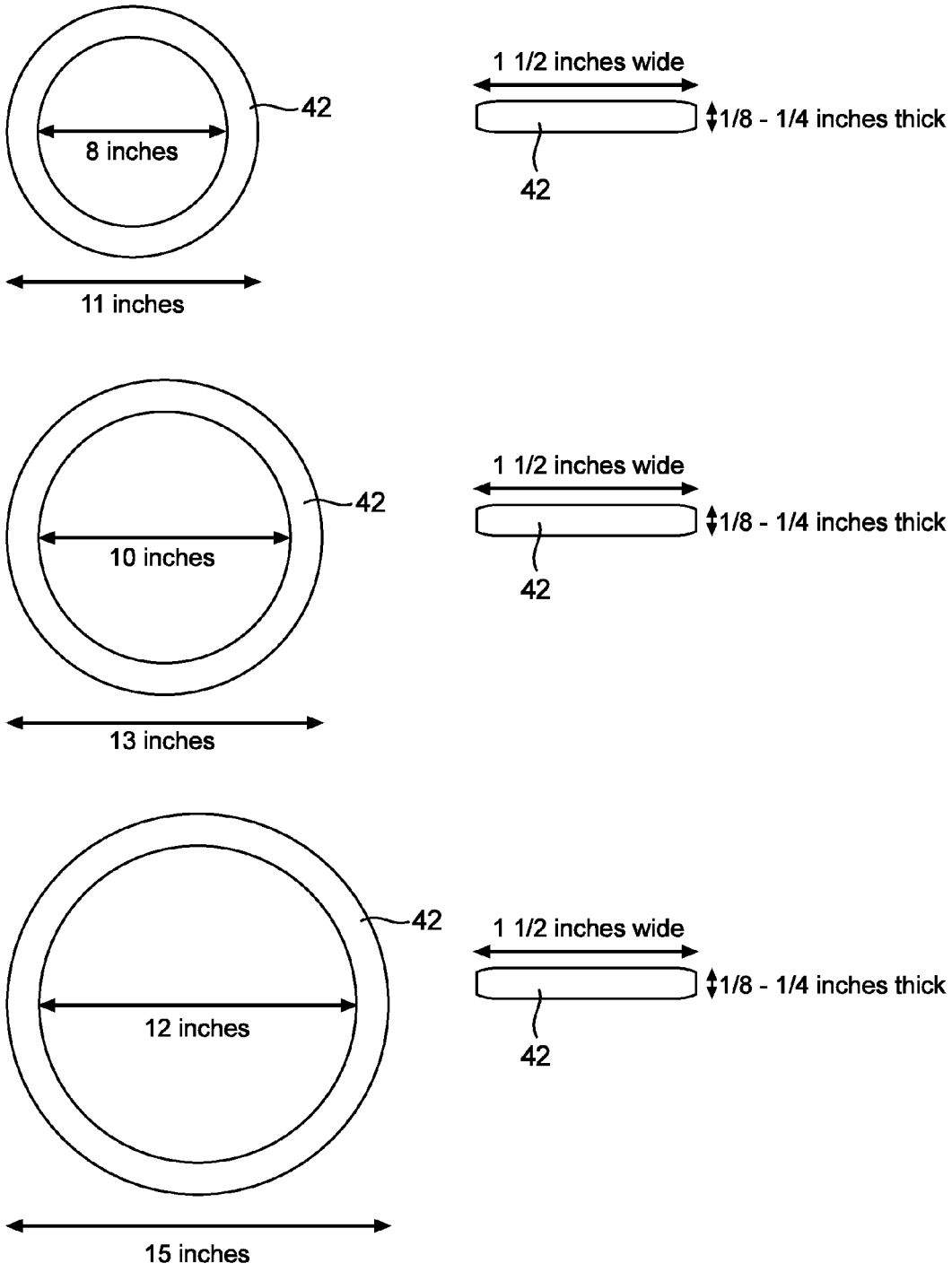
FIG. 4 illustrates a front and side views of a series of representative hoops of various sizes, according to some embodiments.

Reference will now be made to FIG. 4, which illustrates three representative hoops members 42 having different sizes. These hoop members can be interchangeably used with each of the types of hoops: the standing hoop 30, the door hanging hoop 32, the hanging hoop 37, and the suction hoop 34. The top-most hoop member 42 includes an eight-inch center opening. The middle hoop member 42 includes a ten-inch center opening. The bottom-most hoop member 42 includes a twelve-inch center opening. In other embodiments, the center opening can have various other sizes or shapes. For instance, the center opening can include about a 4-inch opening, about a 6-inch opening, about an 8-inch opening, about a 12-inch opening, about an 18-inch opening, or a greater than about an 18-inch opening. Moreover, the shape of the center opening can be a triangle, square, or other polygon, in addition to an ellipse, oval, circle, or other suitable shape. As further shown, the hoop member 42 can include a 1.5-inch frame that forms the body of the hoop member. The size of this frame can be increased or decreased depending on the material (e.g., plastic, metal, wood, etc.) used to form the hoop member 42. For example, the frame of the hoop member 42 can be less than about 0.25 inches wide, about 0.25 inches wide, about 0.5 inches wide, about 0.75 inches wide, about 1.0 inch wide, about 1.25 inches wide, about 1.75 inches wide, about 2.0 inches wide, about 2.25 inches wide, about 2.5 inches wide, and greater than 2.5 inches wide.

Figure 5:
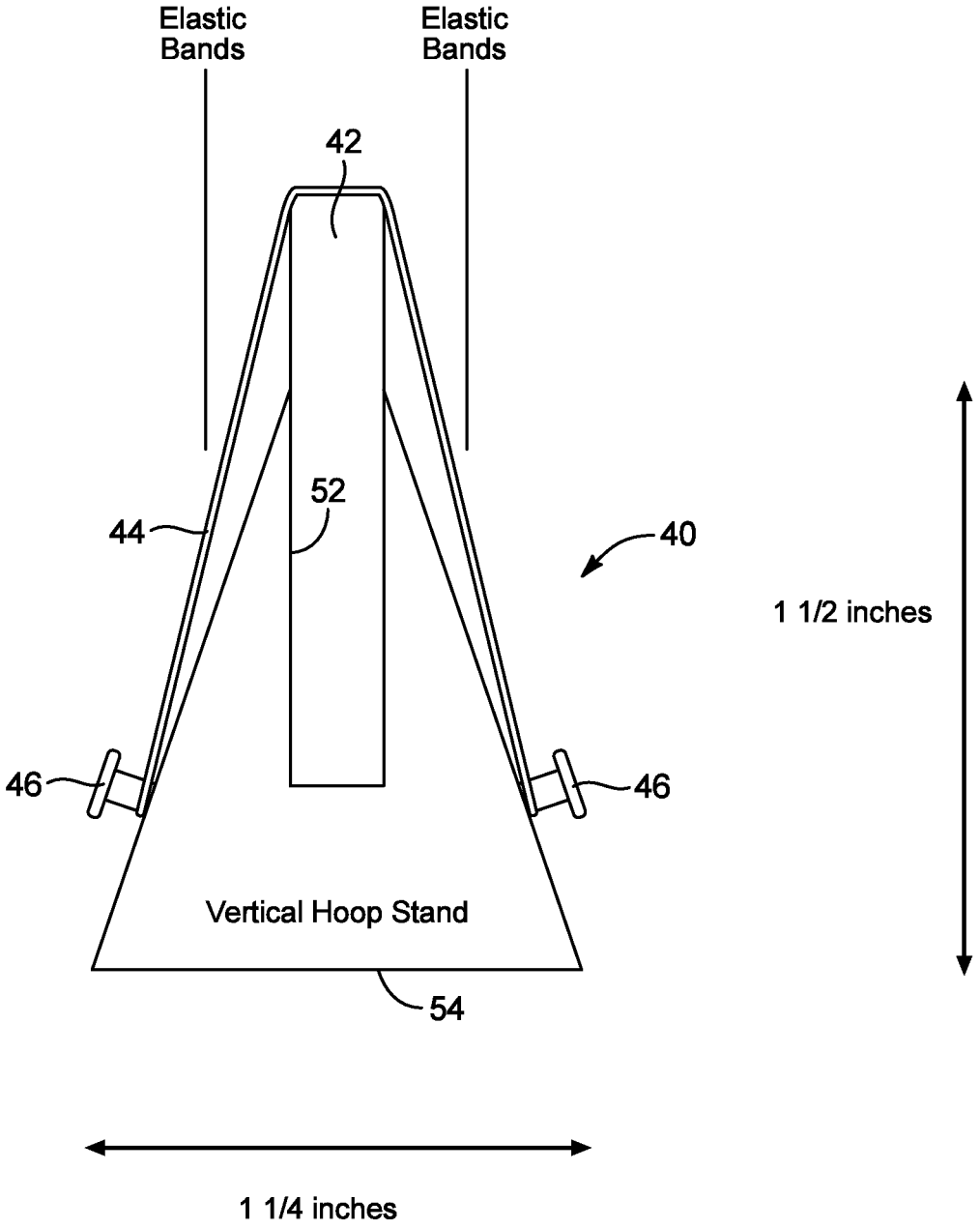
FIG. 5 illustrates a side view a base member, according to some embodiments.

Reference will now be made to FIG. 5, which depicts a side view of some embodiments of a base member 40 coupled to a hoop member 42. In some embodiments, the base member 40 can be interchangeable used with each of the types of hoops: the standing hoop 30, the door hanging hoop 32, and the suction hoop 34. As shown, the base member 40 can have a generally triangular or other such cross-section that provides stability to the hoop member 42. A channel 52 can be formed through the base member 40, which is configured to receive the hoop member 42. After a hoop member is placed with the channel 52, a band 44 can secure the hoop member 42 in place. For example, one or more band attachment members 46 can be formed on opposing sides of the base member 40. The band attachment members 46 can be configured to selectively receive and hold in place one or more bands 44. The band attachment members 46 can include knobs, books, or others features configured to receive and hold a band. In some configurations the bands 53 are rubber bands that can be attached to a band attachment member 46, looped over the hoop member 42, and attached to an opposing band attachment member 46. As shown, the base member 40 can include a base width of approximately 1.25 inches and a height of approximately 1.5 inches. It will be understood that these dimensions can be modified based on the desired size of the base member 40.

Figure 6:
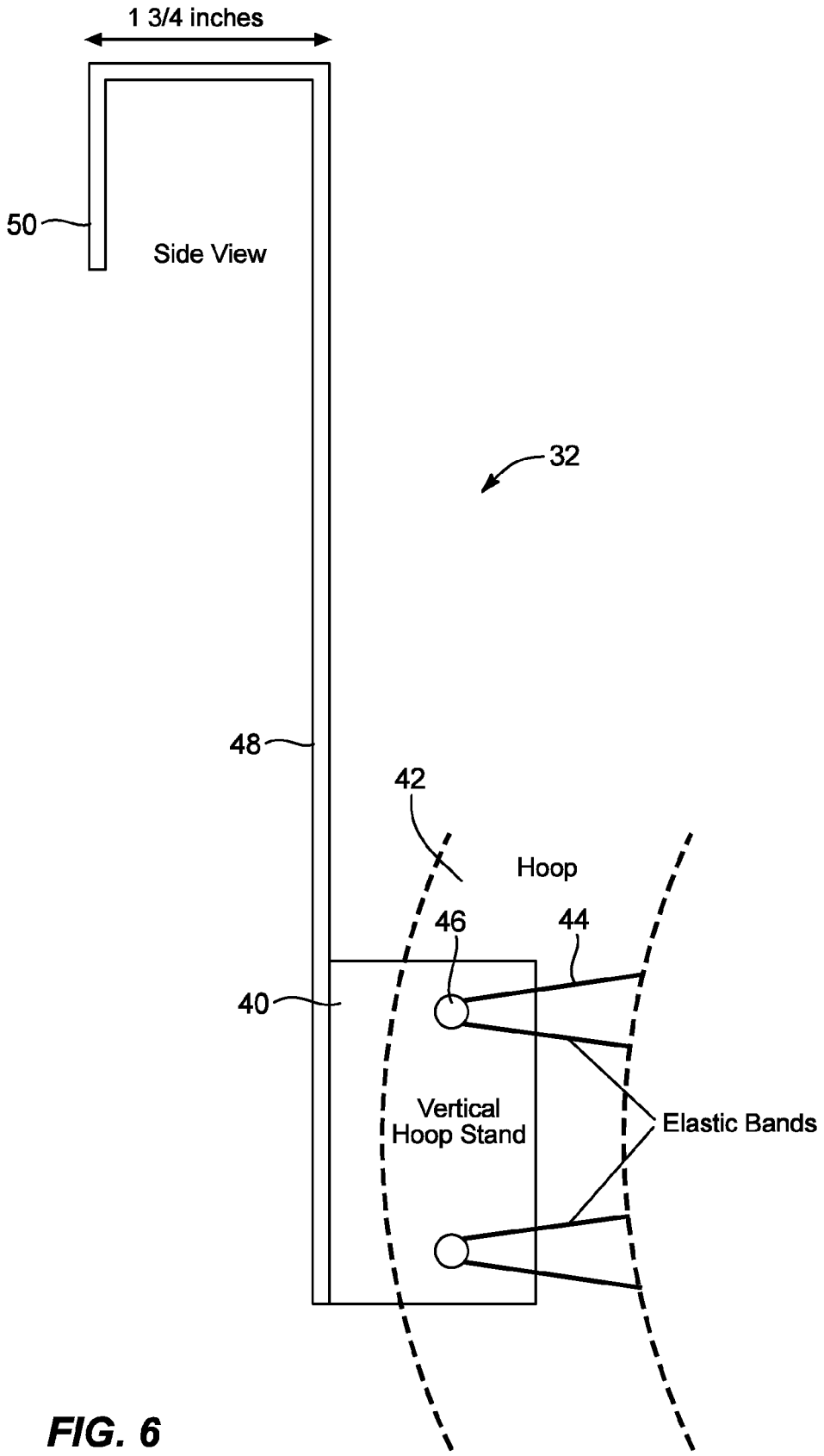
FIG. 6 illustrates a partial front view of a hanging rod, according to some embodiments.

Reference will now be made to FIGS. 6, which illustrates a partial front view of a door hanging hoop 32. As shown, the base member 40 can include two or more band attachment members 46 on a side. This can provide additional stability to the hoop member 42 particularly when hoop member 42 is supported by the base member 40 on a side portion of the hoop member 42. As mentioned, the bands 44 can be rubber bands or another elastomeric band that have elastic properties that can provide flexibility to the door hanging hoop 32 or other hoop structure and reduce the likelihood that the hoop member 42 breaks away from the base member 40.

Figure 7:
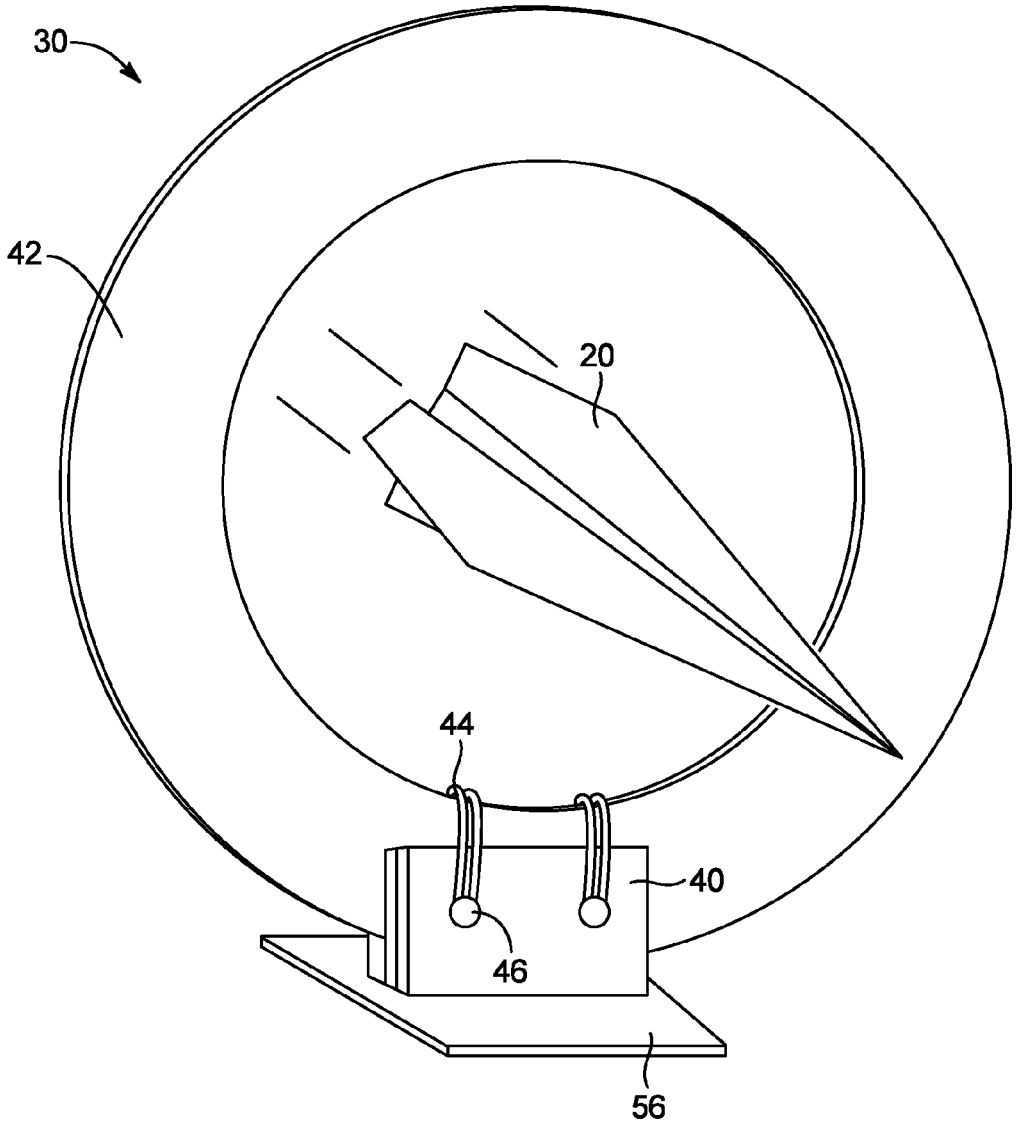
FIG. 7 illustrates a perspective view a representative standing hoop, according to some embodiments.
Figure 8:
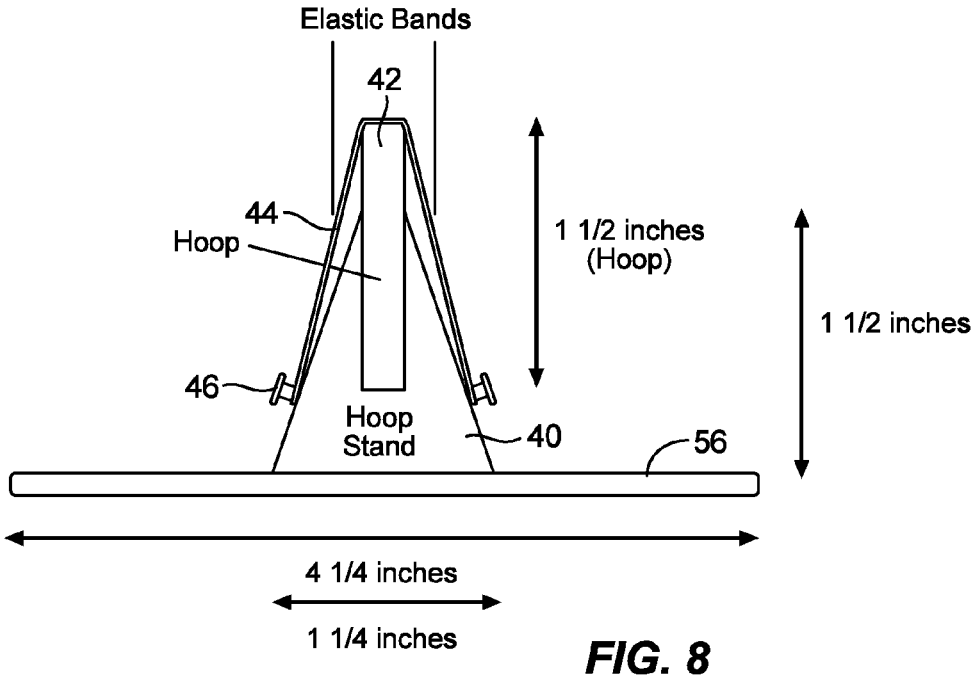
FIG. 8 illustrates a side view of a base member connected to a stand, according to some embodiments.
Figure 9:
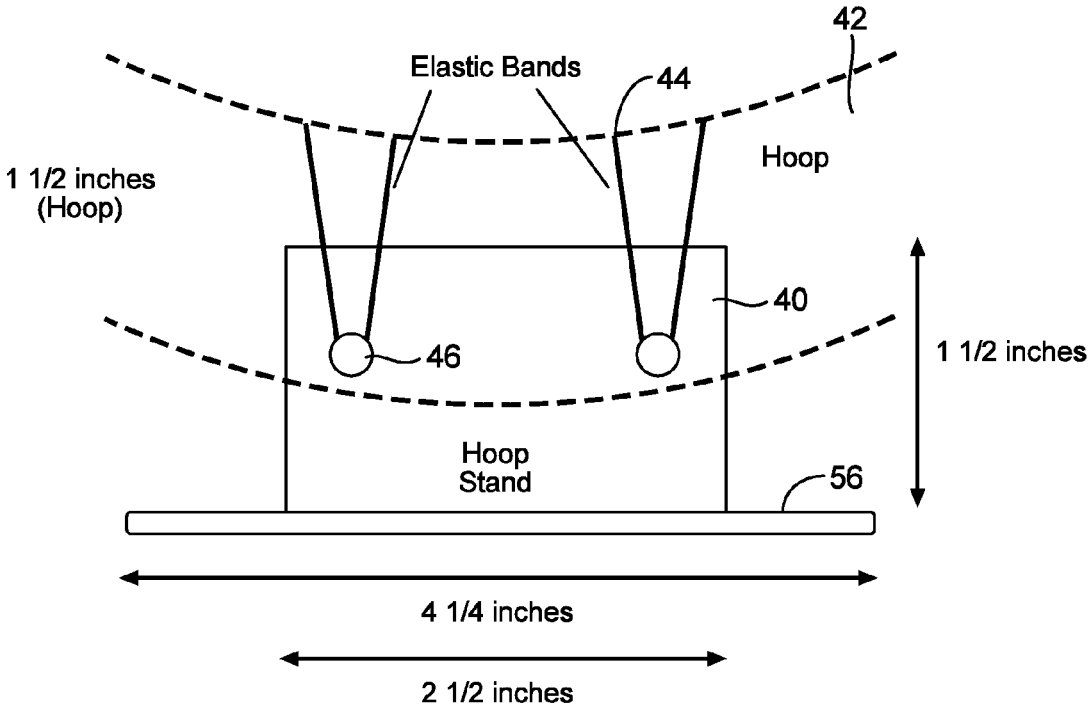
FIG. 9 illustrates a partial front view of a standing hoop, according to some embodiments.

Reference will now be made to FIG. 7, which illustrates some embodiments of a standing hoop 30, which can hold the hoop member 42 upright and be placed on any horizontal or relatively horizontal surface during set up. As shown, the base member 40 can be coupled to a stand 56 and assists in maintaining the hoop member 42 in a substantially vertical position, even in instances when the hoop member 42 is struck with a paper airplane 20. Accordingly, the stand 56 can form a base that is larger than the bottom of the base member 40. For example, the stand 56 can have widths and/or lengths between about 1 inch to about 2 inches, about 2 inches to about 3 inches, about 3 inches to about 4 inches, about 4 inches to about 6 inches, about 6 inches to about 8 inches, about 8 inches to about 12 inches, and greater than about 12 inches. Moreover, the stand 56 can be fixedly or removably coupled to the hoop attachment member 40. FIG. 8 illustrates a side view of a standing hoop 30 with a stand 56 and the dimensions thereof, and FIG. 9 illustrates a front view of a standing hoop 30 with a stand 56 and the dimensions thereof. It will be understood that these dimensions can be modified based on the desired size of the standing hoop 30.

Figure 10:
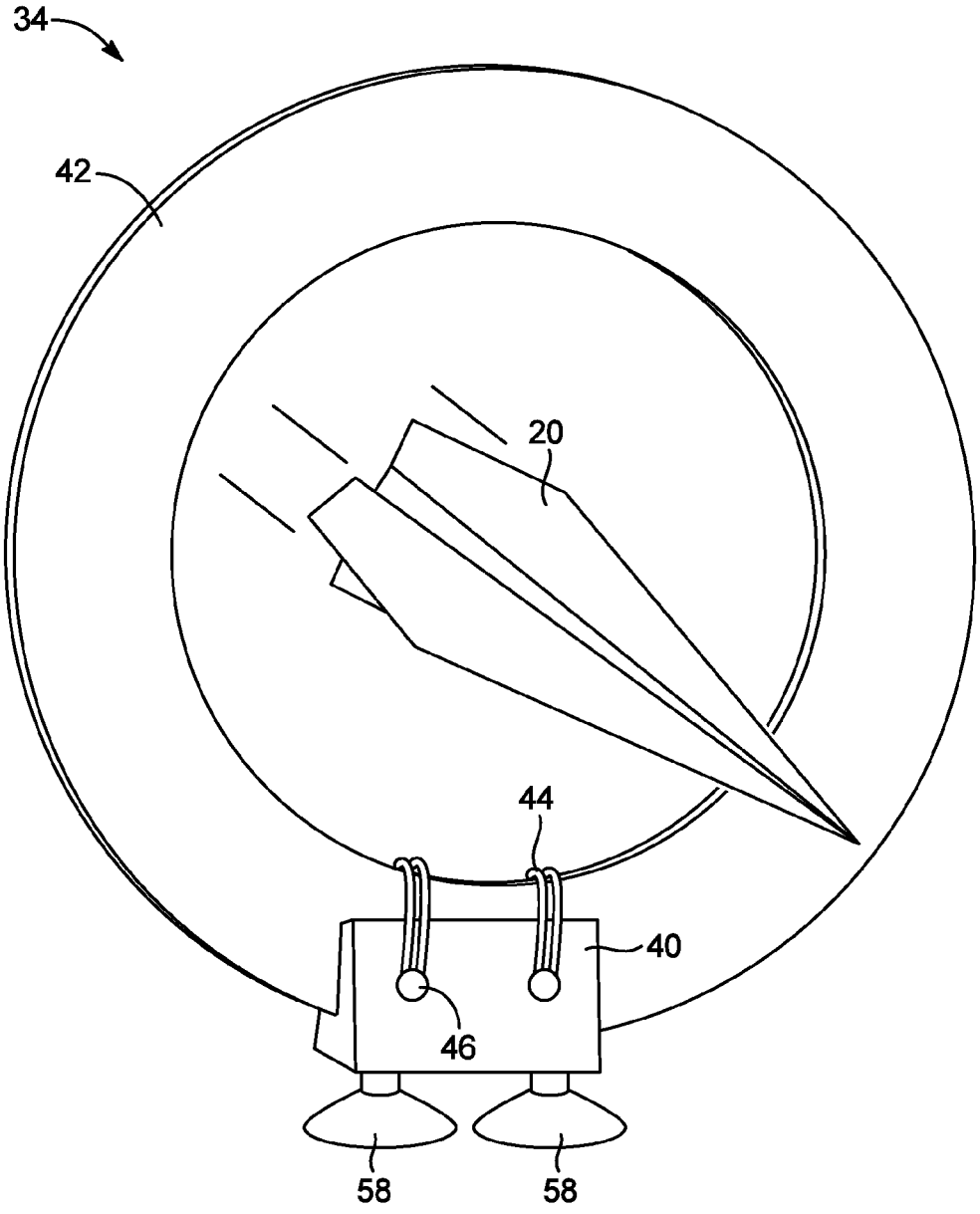
FIG. 10 illustrates a perspective view of a representative suction hoop, according to some embodiments.
Figure 11:
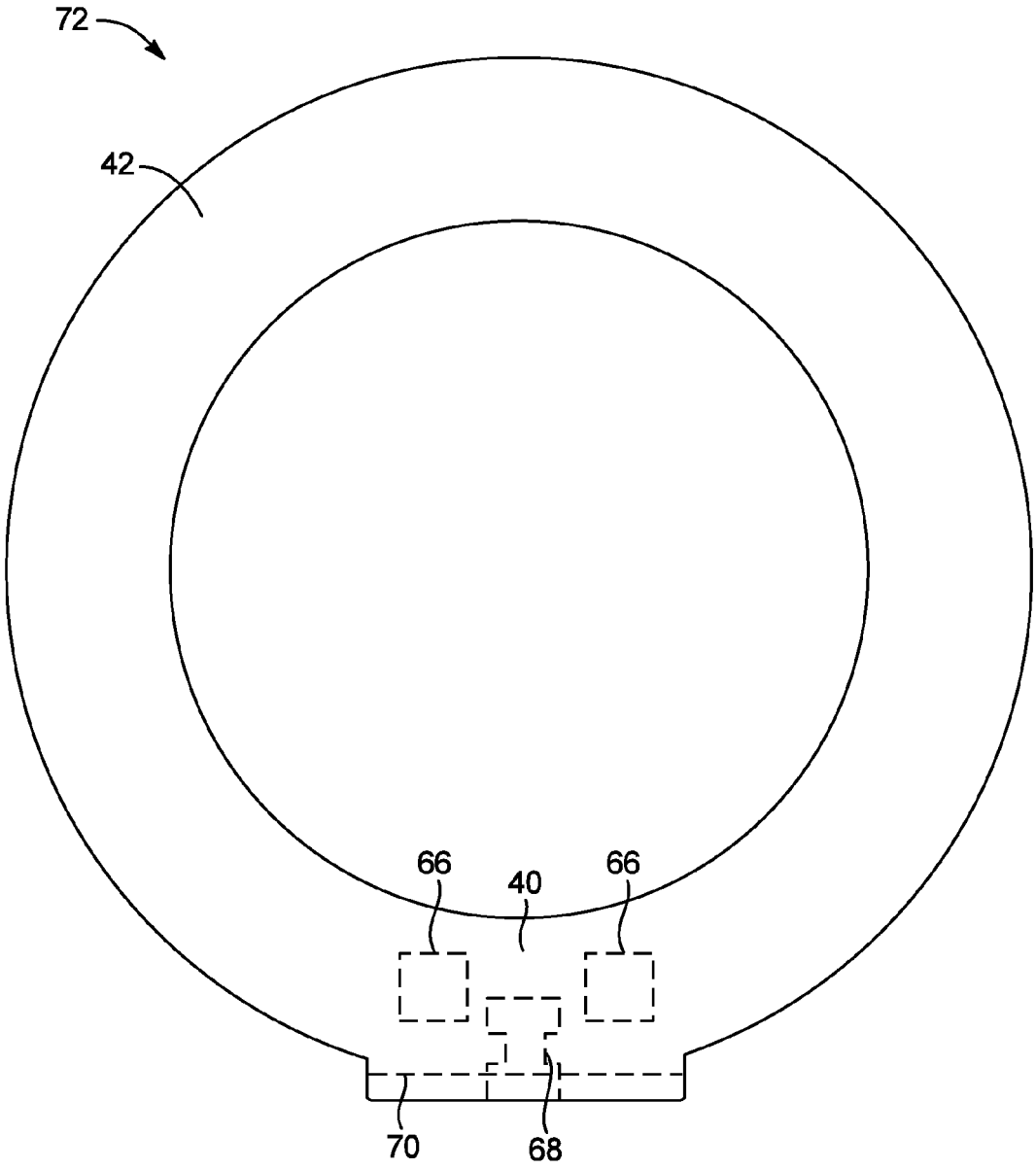
FIG. 11 illustrates a front view of an integrated hoop and base member, according to some embodiments.

Reference will now be made to FIG. 10, which illustrates some embodiments of a suction hoop 34 which can be stuck on a variety of relatively flat surfaces during the game setup. For example, the suction hoop 34 can be attached to a window pane, an flat horizontal surface, a flat inclined surface, a ceiling, or other flat surfaces of various objects. The suction cups 58 can enable the suction hoop 34 to provide wide-ranging versatility to the number of locations onto which hoops can be hung during the game. This same versatility can provide challenge and diversity to the game by allowing the suction hoop 34 to be oriented in nearly any manner. As shown, the suction hoop 34 can include one or more suction cups 58 fixedly or removably coupled to the base member 40.

FIG. 11 illustrates some alternative hoop embodiments, in which the hoop member 42 and the base member 40 are combined into an integrated hoop and base member 72. In these various embodiments of the integrated hoop and base member 72 and the base member 40 (as described above), the base member 40 can include weights 66, one or more cavities 68 for receiving a suction cup 58, and/or a support channel 70 for selectively coupling to a support, such as a hanging rod 48 or a stand 56. These various embodiments can reduce the need for bands 44 and may reduce the overall part count of the kit 26.

Figure 12:
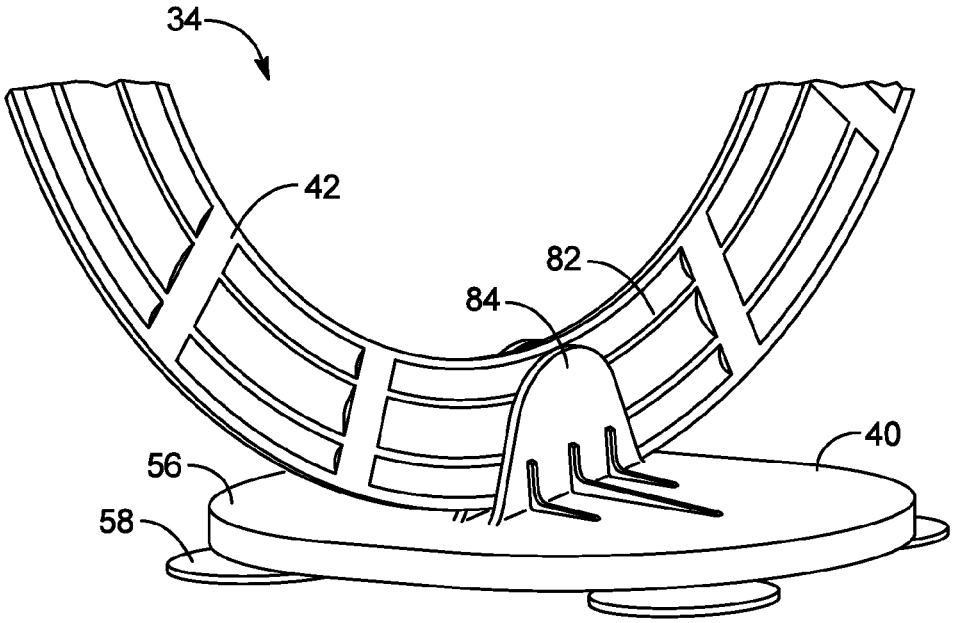
FIG. 12 illustrates a partial perspective view of another embodiment of a base member and hoop member, according to some embodiments.
Figure 13:
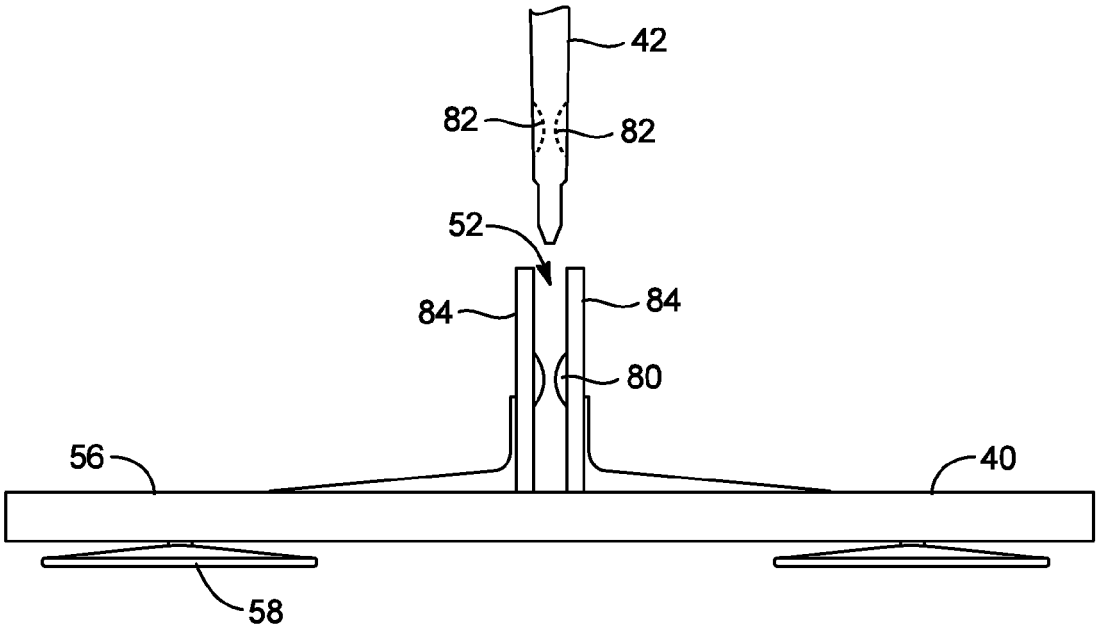
FIG. 13 illustrates a side view of the embodiments of the base member and the hoop member of FIG. 12, with the hoop member being separated from the base member.

Reference will now be made to FIGS. 12 and 13, which illustrates other representative embodiments of a base member 40. As show, the base member 40 can be coupled to the hoop member 42 via a press fit or snap fit type fitting. For example, the channel 52 of the base member 40 can include one or more protrusions 80, bumps, ridges, springs, or other outwardly directed structures that press against or mate with portions of the hoop member 42. The hoop member 42 can alternatively include one or more channels 82, holes, indents, or other inwardly directed structures that mate with or at least partially receive the outwardly directed structures (e.g., the channels 82). As shown, the hoop member 42 can include one or more channels 82 that extend completely or partially around one or both sides of the hoop member 42. To accommodate the press fit or snap fit connection, the rising walls 84 of the base member 40 that form the channel 52 can be configured to flex outward during the insertion of the hoop member 42 into the channel 52 and apply an inward pressure on the hoop member 42 after it is situated within the channel 52. The rising walls 84 can be substantially parallel and form the channel 52 between the two walls. The shape and size of the rising walls 84, the channel 52, the outwardly directed structures, and inwardly directed structures can be made so that the base member 40 can retain the hoop member 42 therein in any orientation. These components can also be shaped and sized to allow an average user to insert and remove the hoop member 42 from the base member 42 without requiring excessive force.

FIGS. 12 and 13 further show that the stand 56, a platform, or other such structure can be integrated into the base member 40. In some embodiments, this stand 56 can be used with the suction hoop 34, as shown, to support two or more suction cups 58.

Figure 14:
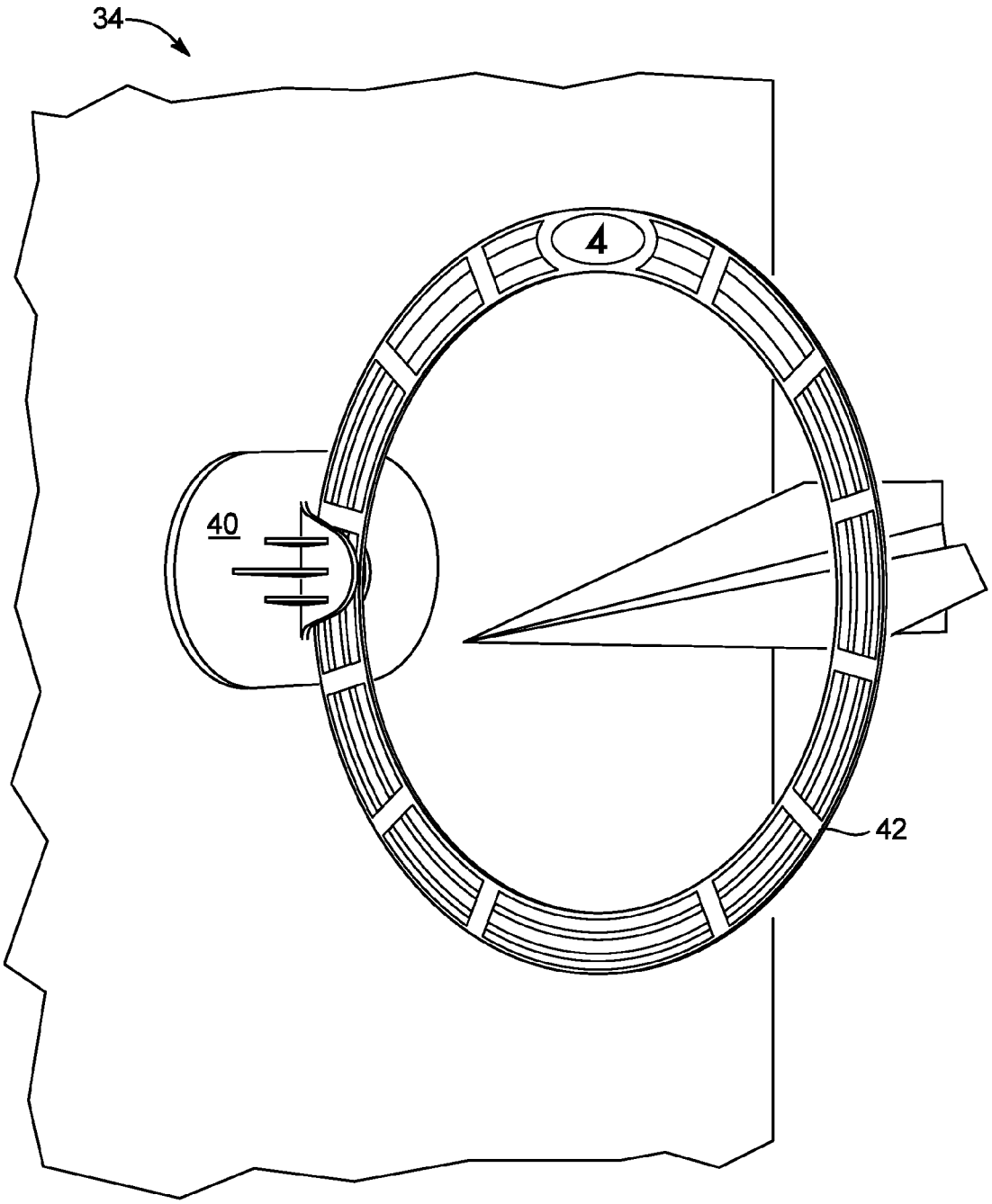
FIG. 14 illustrates a perceptive view of a representative suction hoop, according to some embodiments.
Figure 15:
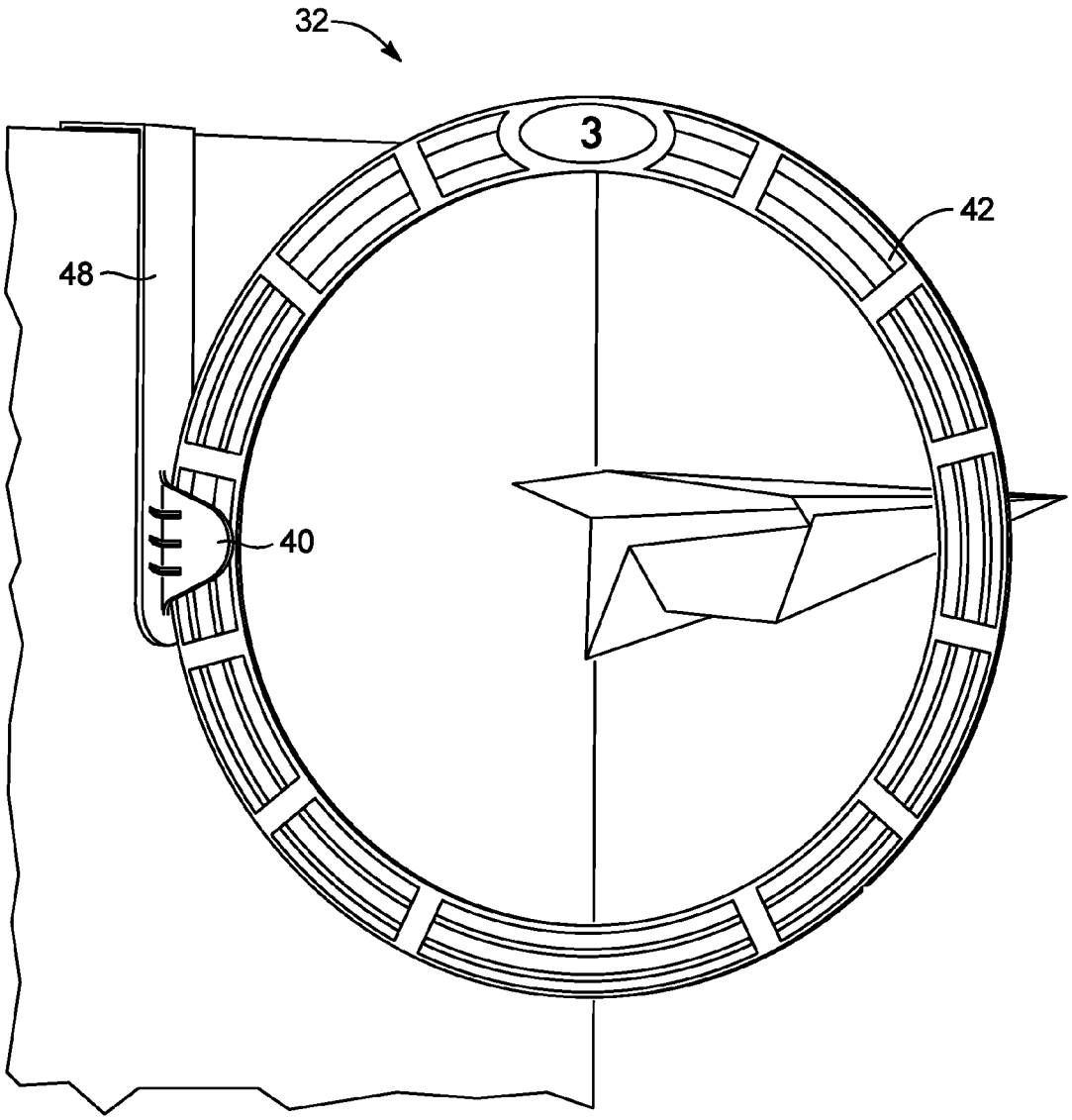
FIG. 15 illustrates a perceptive view of a representative door hanging hoop, according to some embodiments.
Figure 16:
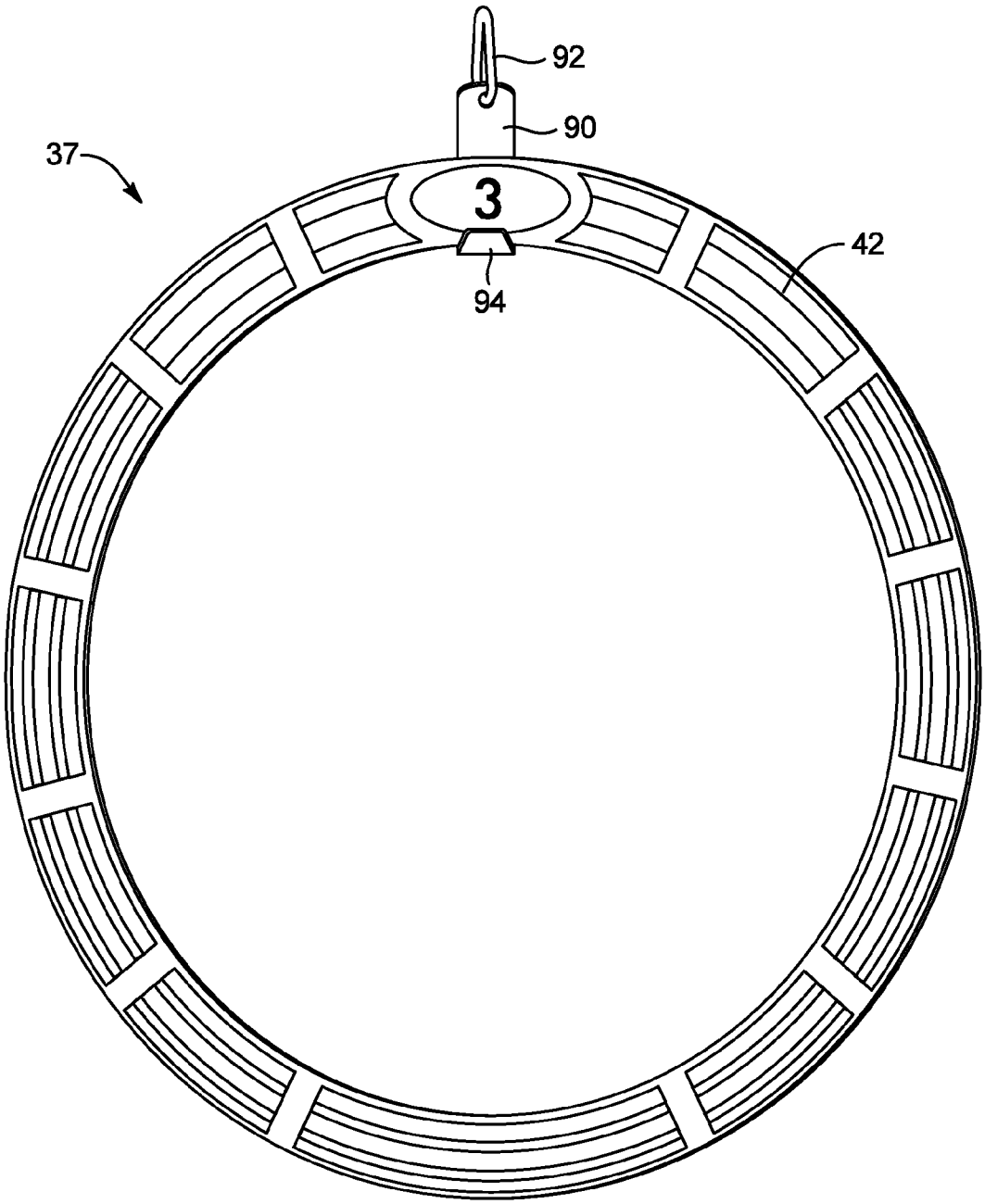
FIG. 16 illustrates a perceptive view of a representative hanging hoop, according to some embodiments.

FIGS. 14 through 16 illustrate embodiments of the suction hoop 34, door hanging hoop 32, and hanging hoop 37, which include the representative base member 40 depicted in FIGS. 12 and 13.

Referring specifically to FIG. 15, the hanging hoop 37 can include a hook 90 and extension 92 in addition or alternative to the base member 40. The hook 90 can be shaped and sized to receive a hoop member 42 and secure it in place. For example, the hook 90 can completely around one wide face of the hoop member 42 and have a portion 94 that partially wraps around an opposite face of the hoop member 42. The hook 90 can be coupled to a rope, extension, or other such structure that attached to a base member 40 or other attachment device or which wraps around an object from which the hanging hoop 37 hangs.

Figure 17:
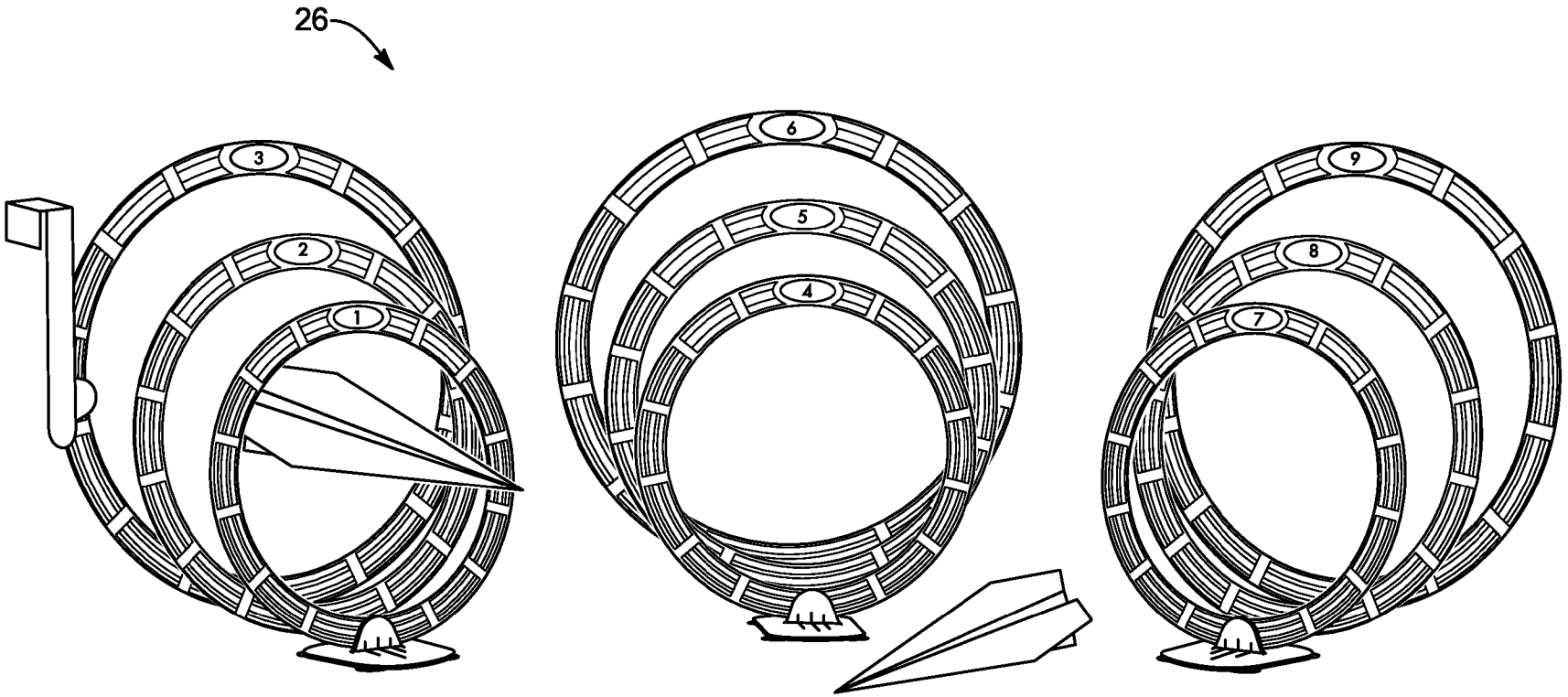
FIG. 17 illustrates at least some components included in another representative kit used in a paper airplane game.

FIG. 17 illustrates a complete or partial kit for the paper airplane game, with airplanes, various sized hoop members 42, and various base members 40.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A paper airplane game kit comprising:

one or more standing hoops, each standing hoop comprising an integrated base member fixedly coupled to the standing hoop;

one or more door hanging hoops, each hanging hoop comprising an integrated base member fixedly coupled to the hanging loop; and one or more suction hoops, each suction hoop comprising an integrated base member fixedly coupled to the suction hoop;

wherein each integrated base member comprises a support channel configured to detachably couple one or more of a hanging rod, a suction cup, and a table stand;

wherein each integrated base member comprises a cavity configured to selectively secure a suction cup and wherein said kit further comprising a plurality of sheets of paper.

2. The paper airplane game kit of claim 1, further comprising a plurality of scorecards.

3. The paper airplane game kit of claim 1, wherein the integrated base member comprises weights.

4. A paper airplane game kit comprising:

a plurality of hoops of various sizes;

a plurality of base members;

one or more hanging rods;

one or more table bases; and one or more suction cups;

wherein each base member comprises a channel disposed on a top surface, the channel configured to selectively and detachably receive an edge portion of a hoop such that the base member can selectively and detachably couple hoops of various sizes;

wherein each base member is also configured to selectively and detachably couple at a bottom surface with each of the hanging rods, the table bases, and the suction cups;

wherein each base member comprises a first band attachment disposed on a first side surface and a second band attachment disposed on an opposite second side surface, the first band attachment configured to selectively and detachably couple a first loop of a circular band and the second band attachment configured to selectively and detachably couple a second loop of the circular band, a remaining portion of the circular band traversing an opening of the hoop to secure the hoop to the base member and wherein said kit further comprising a plurality of scorecards.

5. The paper airplane game kit of claim 4, further comprising a plurality of sheets of papers.

6. The paper airplane game kit of claim 4, further comprising a plurality of rubber bands.

7. The paper airplane game kit of claim 4, wherein each circular band comprises an elastomeric band configured to provide flexibility and configured to reduce the likelihood that the hoop detaches from the base member.

8. The paper airplane game kit of claim 4, wherein each base member comprises a generally triangular cross-section.

9. The paper airplane game kit of claim 4, wherein the band attachments comprise one or more of knobs and hooks.

10. The paper airplane game kit of claim 4, wherein each table base is configured to maintain the hoop in a substantially vertical position.

11. A paper airplane game kit comprising:

a plurality of hoops of various sizes;

a plurality of base members;

one or more hanging rods;

one or more table bases; and one or more suction cups;

wherein each base member comprises a pair of rising walls that form a channel disposed on a first end, the channel configured to selectively receive a portion of a hoop and detachably couple the hoop with a snap fit or a press fit and wherein within the rising walls one or more protrusions that protrude into the channel, the protrusions configured to mate with the protrusions of the hoop and wherein the rising walls are configured to flex outward during insertion of the hoop and to apply inward pressure on the detachably coupled hoop and wherein the kit further comprises sheets of paper with printed lines indicating where to fold the sheets of paper to form a paper airplane.

12. The paper airplane game kit of claim 11, further comprising one or more suction cups coupled to the base member.

13. The paper airplane game kit of claim 11, further comprising a hanging rod coupled to the base member.

14. The paper airplane game kit of claim 11, further comprising a table base coupled to the base member.

* * * * *